US005561999A

United States Patent [19]

Stevenson

[11] Patent Number: 5,561,999

[45] Date of Patent: Oct. 8, 1996

[54] RING FORMING METHOD

[76] Inventor: Robert G. Stevenson, 20 S. Lakeview Dr., Goddard, Kans. 67052-9252

[21] Appl. No.: 356,739

[22] Filed: Dec. 15, 1994

[51] Int. Cl.[6] ..... B21D 28/02

[52] U.S. Cl. ..... 72/337; 72/339; 72/379.6

[58] Field of Search ..... 72/334–337, 339, 72/385, 379.6; 83/694, 686, 689, 684, 857

[56] References Cited

U.S. PATENT DOCUMENTS

| | | | |
|---|---|---|---|
| 155,098 | 9/1874 | Merriken | 72/336 |
| 1,159,322 | 11/1915 | Livingston | 72/379.6 |
| 2,219,602 | 10/1940 | Rayner | 83/694 |
| 2,605,730 | 8/1952 | Dennis | 72/336 |
| 3,460,368 | 8/1969 | Brown . | |
| 3,748,888 | 7/1973 | Gerich | 72/385 |
| 4,958,430 | 9/1990 | Grieb . | |

FOREIGN PATENT DOCUMENTS

| | | | |
|---|---|---|---|
| 1523218 | 11/1989 | U.S.S.R. | 72/385 |

*Primary Examiner*—Daniel C. Crane
*Attorney, Agent, or Firm*—Edward L. Brown, Jr.

[57] ABSTRACT

A method of forming corrugated rings of sheet metal which include the steps of: punching a circular area in the sheet material; punching a plurality of kidney-shaped areas concentrically spaced around the circular hole forming an annular area still connected to the sheet material; deforming the annual area between two mating dies having equal radius radial corrugations therein to corrugate the annual area and concentrically punching the corrugating annular area between a circular punch and a corresponding die, the punch and die having mating cutting surfaces which are corrugated and mate with the corrugated annual area of the sheet thereby forming a circular ring having radial corrugations.

4 Claims, 2 Drawing Sheets

RING FORMING METHOD

BACKGROUND OF THE INVENTION

The invention relates to a metal stamping and more specifically to the formation of relatively thin gauge stainless steel rings having radially spaced corrugation in the ring. A plurality of these rings are placed alternately in a stack with totally flat rings placed between them with the corrugation providing a series of small openings for a gas burner utilized in camping stoves. Burners of this type have been sold in the marketplace for years. The old method of forming these corrugated rings was to stamp the rings first in flat form and then individually place each flat ring between a pair of mating radial corrugated dies to form the corrugations. The new method basically reverses the process in that it first stamps the radial corrugations in an annular area of sheet stock and then punches out the ring parts with dies which are not flat, but rather corrugated on their mating cutting surfaces so the previously formed corrugations are not flattened during cutting of the rings.

The general idea of utilizing a kidney-shaped slot for maintaining alignment of a part within a sheet while additional stamping operations are made is generally taught in the patent to Grieb, U.S. Pat. No. 4,958,430. The idea is also generally taught in the patent to Brown, No. U.S. Pat. No. 3,460,368, wherein the kidney slot 69 and center hole 65 are removed prior to the final curvature stamping of the washer.

SUMMARY OF THE INVENTION

The method of the present invention first stamps the radial corrugations into a sheet of material and then punches out ring parts with a punch and die. The cutting surface of the punch and die are not flat but rather corrugated along their cutting surfaces so when the rings are cut out, the previously formed corrugations are not flattened. The method includes the following steps. The initial sheet material being stamped is in a roll and at the first station, a conventional die punches out a circle and two kidney slots, concentrically positioned with respect to the circle thereby forming an annular area there between. The annular area remains connected to the initial sheet through small web areas. The annular area is then stamped between a pair of mating dies having radial corrugations therein so as to corrugate the annular area. The next step involves a punch and die which stamps out a ring from the inside diameter of the annular area. The cutting surfaces of the punch and its corresponding die are corrugated in shape so as not to flatten the previously formed corrugations.

The principal object of the present invention is to provide an automated metal stamping method which utilizes automated high speed punch presses in their formation.

DESCRIPTION OF THE DRAWINGS

These and other advantages and objects will become apparent from the following detailed description taken in conjunction with the drawings in which.

DETAILED DESCRIPTION OF THE DRAWINGS

Figure 1:
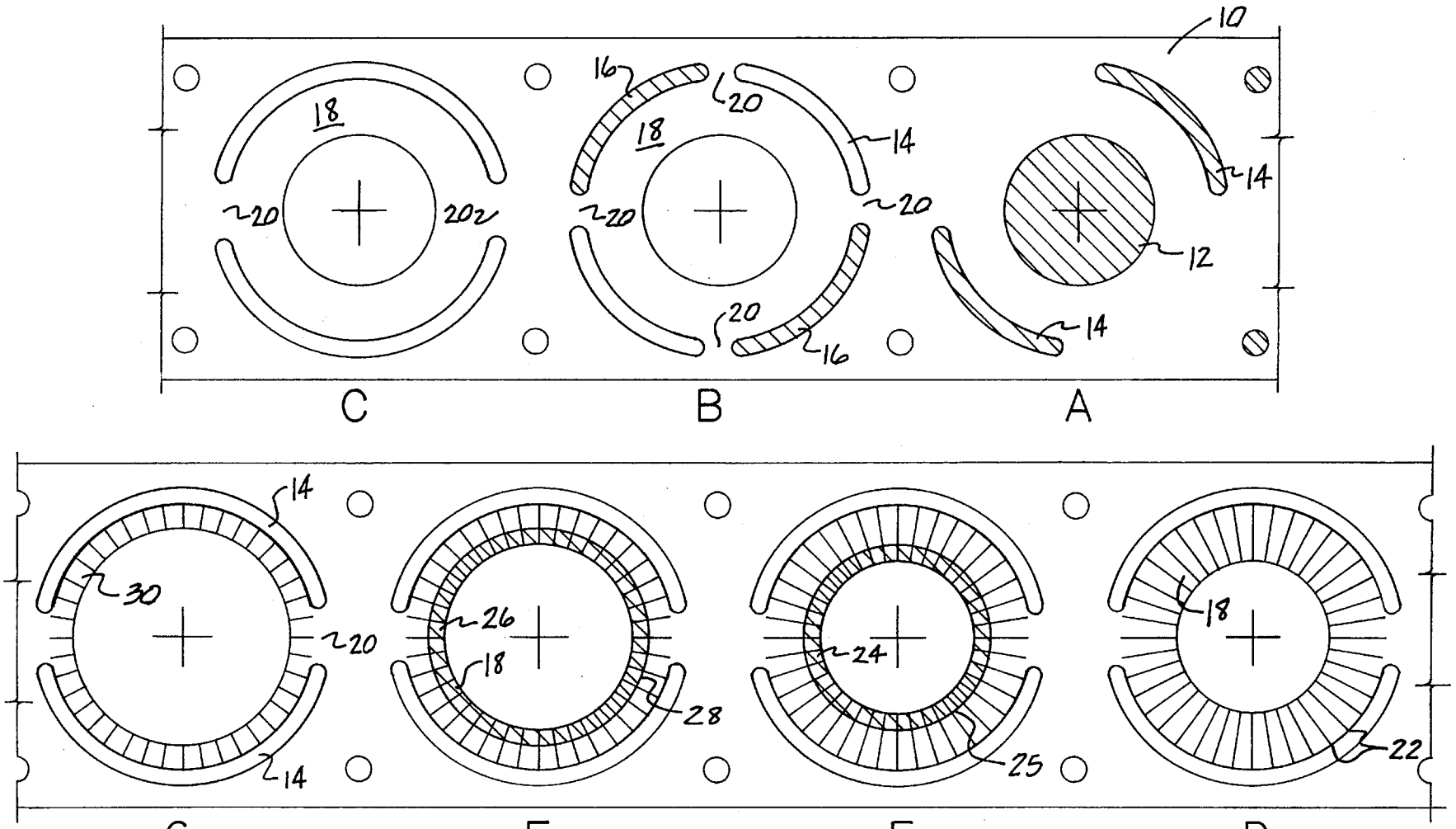
FIG. 1 is a plan view of sheet material symbolically illustrating the various forming stations which form the corrugated rings.
Figure 2:
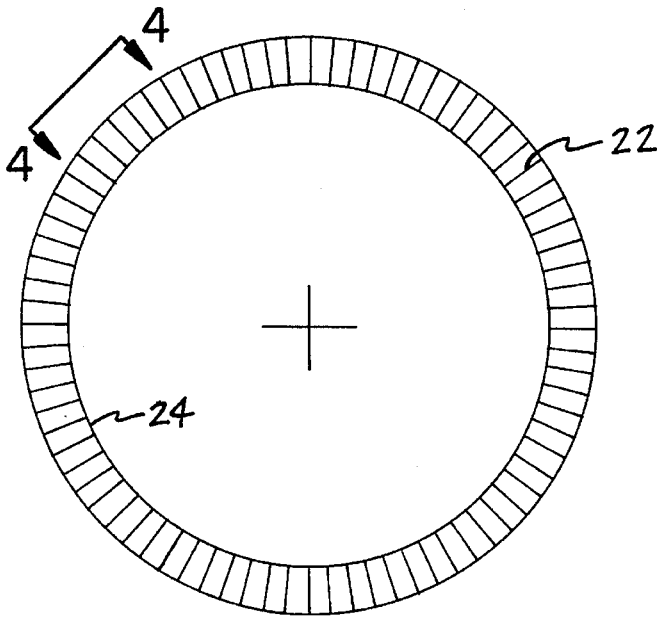
FIG. 2 is a plan view of a formed ring with the corrugations symbolically shown.
Figure 4:
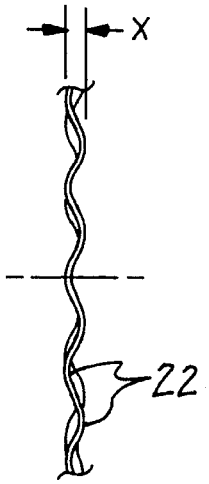
FIG. 4 is a partial side elevational view of the formed ring to an enlarged scale.

Referring to FIG. 1, the sheet material is a thin gauge stainless steel sheet 10 fed into an automated punch press off of a roll, not shown. The punch press, which is also not shown, is well known in the industry. At the first station A, a circular hole 12 and a pair of kidney slots 14 are punched in the sheet 10. At station B, a second pair of kidney slots 16 are punched defining an annular area 18 there between. The web areas 20 connect the annular area 18 to the sheet 10. Station C is an optional step which eliminates two of the web areas 20 while still retaining-the annular area 18 attached to the sheet 10 for additional stamping and punching operations. At station D, two mating corrugated dies, not shown, are brought together forming the annular area 18 into radially positioned corrugations 22, symbolically shown. In FIG. 4, the actual profile shape of the corrugation 22 is shown with an optimum radius of 0.050 inches on each side and a ring thickness x of 0.040 inches.

At station E, the punch and corresponding die for cutting the rings are engaged cutting a ring 24, which is cut out of the inside diameter of the annular area 18, along line 25 to form a corrugated ring 24.

The punch and die at station E both have corrugated mating cutting surfaces with the same geometry and alignment as the corrugations 22 which were stamped in annular area 18 at station D. When the punch and die at station E come together, the corrugations in the punch and die align with the corrugations 22 in the sheet and the ring 24 is sheared along line 25 without deforming any of the corrugations.

At station F, a second punch and die having similar mating corrugated cutting surfaces, with a slightly larger diameter, engage the annular area 18 and cut a second corrugated ring 26 along line 28. The remaining scrap or cut-off is illustrated in station G with a corrugated portion 30 remaining from annular area 18. The reason this corrugated scrap portion 30 is provided is so that all of the corrugations in rings 24 and 26 are all equally formed even in the area of the web 20. The corrugations adjacent the web area 20 are not as fully formed at their outer edges as those adjacent the kidney slots, and therefore a scrap area of imperfect corrugations is provided in the remaining area 30, as seen in station G. Ring 24 which is stamped inside ring 26 is used on a burner configuration having a slightly smaller diameter than the burner that utilizes the ring 26. The number of rings taken from a single annular area 18 could be increased to three or more if there were additional sized burners.

Figure 3:
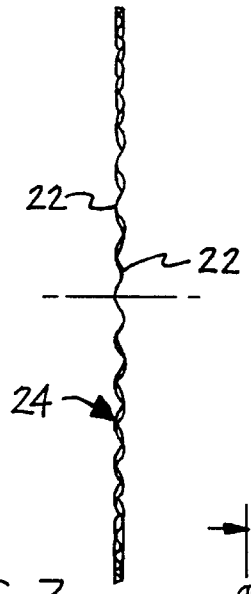
FIG. 3 is a side elevational view of a formed ring.

FIG. 3 illustrates a side view of the entire ring 24 which includes 40 corrugations and a material thickness of 0.010 inches.

I claim:

1. In a method of forming corrugated rings in sheet metal, the steps of:

punching a circular area in the sheet material;

punching one or more kidney-shaped areas in the sheet metal concentrically spaced around the circular area forming an annular area still connected to the sheet material;

deforming the annular area between two mating dies having equal radius radial corrugations thereon to corrugate the annular area; and concentrically punching the corrugated annular area between a circular punch and corresponding die, the punch and die having mating cutting surfaces which are corrugated and mate with the corrugated annular area of the sheet thereby forming a circular ring having radial corrugations therein.

2. In the method of forming corrugated rings as set forth in claim 1 wherein the corrugations have a radius greater than 0.040 inches.

3. In the method of forming corrugated rings as set forth in claim 1 wherein the corrugations are identical on both sides of the ring with a radius greater than 0.040 inches and ring thickness greater than 0.040 inches.

4. In a method of forming corrugated rings in sheet metal, the steps of:

punching a circular area in the sheet metal defining an annular area around the circular area;

deforming the annular area between two mating dies having equal radius radial corrugations thereon to corrugate the annular area; and concentrically punching the corrugated annular area between a circular punch and corresponding die, the punch and die having mating cutting surfaces which are corrugated and mate with the corrugated annular area of the sheet thereby forming a circular ring having radial corrugations therein.

* * * * *